US011859636B2

(12) United States Patent
Patel et al.

(10) Patent No.: US 11,859,636 B2
(45) Date of Patent: Jan. 2, 2024

(54) FAN WHEEL OF A MOTOR VEHICLE

(71) Applicant: Brose Fahrzeugteile SE & Co. Kommanditgesellschaft, Wuerzburg, Wuerzburg (DE)

(72) Inventors: Anand Patel, Pune (IN); Ashish Sonawane, Ahamadnagar (IN); Lutz Wulf, Jade (DE)

(73) Assignee: Brose Fahrzeugteile GmbH & Co. Kommanditgesellschaft, Wuerzburg, Wuerzburg (DE)

( * ) Notice: Subject to any disclaimer, the term of this patent is extended or adjusted under 35 U.S.C. 154(b) by 0 days.

(21) Appl. No.: 18/102,458

(22) Filed: Jan. 27, 2023

(65) Prior Publication Data

US 2023/0243367 A1 Aug. 3, 2023

(30) Foreign Application Priority Data

Jan. 28, 2022 (DE) ..... 10 2022 200 940.1

(51) Int. Cl.

| | |
|---|---|
| ***F04D 29/32*** | (2006.01) |
| ***F04D 29/38*** | (2006.01) |
| ***F04D 19/00*** | (2006.01) |
| ***F04D 25/12*** | (2006.01) |

(52) U.S. Cl.

CPC ..... *F04D 29/388* (2013.01); *F04D 19/002* (2013.01); *F04D 25/12* (2013.01); *F04D 29/326* (2013.01); *F04D 29/329* (2013.01); *F04D 29/386* (2013.01)

(58) Field of Classification Search

CPC ..... F04D 29/388; F04D 19/002; F04D 29/326
See application file for complete search history.

(56) References Cited

U.S. PATENT DOCUMENTS

| | | | | |
|---|---|---|---|---|
| 4,957,414 | A | 9/1990 | Willingham | |
| 10,563,664 | B2 * | 2/2020 | Springer | F04D 29/326 |
| 2016/0273546 | A1 | 9/2016 | Chan et al. | |
| 2018/0372120 | A1 * | 12/2018 | Moser | F04D 29/542 |
| 2022/0112901 | A1 | 4/2022 | Mauss | |

FOREIGN PATENT DOCUMENTS

| | | | |
|---|---|---|---|
| DE | 60015628 | T2 | 11/2005 |
| DE | 202019100367 | U1 | 4/2020 |
| DE | 102019216704 | A1 * | 5/2021 |
| DE | 102019216704 | A1 | 5/2021 |
| FR | 3053625 | A1 | 1/2018 |

* cited by examiner

*Primary Examiner* — Sabbir Hasan
(74) *Attorney, Agent, or Firm* — Muncy, Geissler, Olds & Lowe , P.C.

(57) ABSTRACT

A fan wheel and a radiator of a motor vehicle, the fan wheel having a hub to which a number of fan blades is connected. The fan blades each have a stabilizing structure of a first material, which is surrounded by means of a respective body of a second material.

7 Claims, 5 Drawing Sheets

FAN WHEEL OF A MOTOR VEHICLE

This nonprovisional application claims priority under 35 U.S.C. § 119(a) to German Patent Application No. 10 2022 200 940.1, which was filed in Germany on Jan. 28, 2022, and which is herein incorporated by reference.

BACKGROUND OF THE INVENTION

Field of the Invention

The present invention relates to a fan wheel of a motor vehicle, having a hub to which a number of fan blades are connected. The fan wheel is preferably a component of a radiator fan of the motor vehicle. The invention further relates to a radiator fan of a motor vehicle, such as a main fan.

Description of the Background Art

Motor vehicles with an internal combustion engine generate considerable heat during operation that is also used to maintain the operating temperature of the combustion engine, which in turn must be cooled. If the motor vehicle has an electric motor for propulsion, a high-voltage energy storage device is charged and discharged during operation, wherein heat loss also occurs here, so that the high-voltage energy storage must be cooled. For cooling and also for the operation of an air conditioner, a liquid coolant is usually used, which is thus heated. To cool the coolant again, a radiator network charged by a wind is usually used, which is in heat exchange to the coolant. For example, the coolant is fed into pipes that are incorporated into the cooling network. Since the air stream is usually not sufficient for cooling, especially at low vehicle speeds, it is known to use an electric fan by means of which the air stream is amplified or a corresponding wind is generated.

Usually, the fan is located in the direction of travel behind the radiator network. With the help of a fan wheel of the fan, the air is sucked through the radiator network and, if necessary, directed to the combustion engine. There, the air absorbs excess heat from the combustion engine and transports it away.

In order to achieve a comparatively high air volume flow rate through the cooling network, it is possible to rotate the fan wheel at a comparatively high rotation speed. However, it is possible that, on the one hand, an air stream breaks off. On the other hand, comparatively high-frequency oscillations occur in this way, which can be perceived as disturbing. Alternatively, it is possible to select a comparatively large diameter of the fan wheel. The fan wheel is usually designed one-piece as a plastic injection molded part. With a comparatively large diameter, it is possible that due to the air stream, the fan blades are bent at the end, so that on the one hand the effectiveness is reduced. On the other hand, it is possible that the fan blades grind on other components of the vehicle, which leads to wear and annoying noise. To remedy this, an outer ring is usually provided, by means of which the fan blades are surrounded on the circumferential side, and to which they are attached. Due to the outer ring, however, a return flow of air in this area is favored, which is why the air volume flow rate is reduced.

SUMMARY OF THE INVENTION

It is therefore an object of the present invention to provide a particularly suitable fan wheel of a motor vehicle and a particularly suitable radiator fan of a motor vehicle, wherein in particular an air volume flow rate is increased and/or noise is reduced during operation.

With regard to the fan wheel and the radiator fan, this object is achieved by the features of the claimed invention. Advantageous further developments and embodiments are the subject of the respective subclaims.

The fan wheel is a component of a motor vehicle and, in particular, a component of a radiator fan. Here, the fan wheel is suitable, in particular provided and configured to suck or blow air through a radiator of the motor vehicle. The radiator fan and thus also the fan wheel are preferably used for cooling a combustion engine or a high-voltage energy storage device, such as a high-voltage battery of the motor vehicle. Suitably, a coolant is cooled by means of the radiator, and/or by means of the fan wheel, an air stream is directed to a potential internal combustion engine. Alternatively, the fan wheel is, for example, a component of a blower, by means of which in particular air is transported into a passenger compartment of a motor vehicle. The motor vehicle is suitably land-based and, for example, a passenger car. Alternatively, the motor vehicle is a commercial vehicle, such as a truck or a bus.

The fan wheel has in particular an essentially flat design. At least, however, the extent of the fan wheel in a plane is greater than perpendicular to it. The fan wheel is suitable, in particular intended and configured to be rotated about one axis of rotation. In particular, the axis of rotation is perpendicular to the plane within which the fan wheel is arranged. The fan wheel is preferably an axial fan wheel. Thus, air is moved along the axis of rotation during operation by means of the fan wheel. The diameter of the fan wheel is conveniently between 20 cm and 50 cm, between 25 cm and 45 cm and, for example, substantially equal to 30 cm, wherein in each case a deviation of 5 cm, 2 cm or 0 centimeter is present.

The fan wheel itself has a hub to which a number of fan blades are connected. The hub is suitable, in particular provided and configured to be attached to an electric motor. In the assembly state, the potential electric motor is conveniently attached to the hub, by means of which the fan wheel is rotated about the axis of rotation. Here, the hub is suitably arranged concentrically to the axis of rotation, which reduces an imbalance and thus unwanted noise and excessive load. Preferably, the hub is substantially designed in the shape of a pot, wherein a pot bottom is conveniently arranged substantially perpendicular to the axis of rotation. The fan blades are suitably connected to an outer circumference of a wall of the pot-shaped hub. Conveniently, if the hub is designed pot-shaped, the pot opening is arranged counter to a potential air stream, in particular a direction of wind and/or a direction of movement of the motor vehicle. Thus, air resistance is reduced. Conveniently, the hub is designed substantially smooth on the outside.

The fan blades, in particular also referred to as fan wheel blades, are preferably identical to each other, which simplifies production and assembly. For example, the fan blades are inclined with respect to the axis of rotation. Thus, each of the fan blades has a main extension direction, which is inclined with respect to the axis of rotation. In particular, an angle between 10° and 80° or between 20° and 70° is formed. Due to the inclination, the fan wheel moves air in the axial direction during operation, i.e., along the axis of rotation or at least parallel to it. Each of the fan blades also has a substantially radial course, in particular with respect to the axis of rotation, so that the fan blades point outwards from the hub.

Particularly preferably, the fan blades are curved so that this way, a sickle shape is expediently formed. Thus, the radial outer end is offset with respect to the radial inner end of the respective fan blade in the tangential direction with respect to the axis of rotation. Suitably, the direction in which all radially outer ends of the fan blades are offset is the same, so that the fan wheel is designed turbine-like.

Each of the fan blades has a stabilizing structure made of a first material. The first material, for example, is a metal, such as steel. Alternatively, the first material is a plastic, which is, for example, glass fiber reinforced or carbon fiber reinforced. Alternatively, the first material is formed of glass fibers, carbon fibers or composite fibers. In particular, PP, PA6 or PP-LGF 30 or PA6-GF30 is used as the first material. In addition, each fan blade has a body by means of which the respective stabilizing structure is surrounded, preferably completely. Here, the extent of the body is greater than the extension of the stabilizing structure, and the outer shape of the fan blade is determined by means of the body. Particularly preferably, the body and the stabilizing structure are inseparably connected to each other. The body is made of a second material, which is different from the first material. Suitably, a density of the second material is lower than the density of the first material.

By means of the stabilizing structure, the shape of the respective fan blade is stabilized, wherein the shape itself is predetermined by means of the respective body. Thus, it is possible to use as a second material a material with a reduced intrinsic stability and a reduced weight, so that the weight of the fan wheel is reduced. Due to the stabilizing structure, bending of the fan blades during operation is avoided, so that the dimensional stability of the fan wheel is increased. In other words, bending of the fan blades is avoided during operation, so that an air volume flow rate is increased. In addition, for example, a striking of the radial ends of the fan blades on other components of the vehicle is avoided. In addition, the formation of vibrations within the fan blades is avoided or at least reduced, so that noise is also reduced due to this. Due to the use of the second material for the body, the weight is reduced and therefore the dynamic of the fan wheel is increased, so that it can be operated as required.

For example, the body is manufactured independently of the stabilizing structure, and the body and the stabilizing structure are attached to each other for production, for example by means of a fastener, welding and/or gluing. Particularly preferably, however, the body is created by overmolding the respective stabilizing structure using the second material. In this case, a plastic is preferably used as the second material, and the bodies are thus in particular injection-molded parts. Due to the overmolding of the respective stabilizing structure using the second material for the formation of the respective body, production is simplified on the one hand. On the other hand, detachment of the stabilizing structures from the bodies is safely avoided in this way.

For example, the fan blades and hub are created separately. Particularly preferred, however, the hub or at least a part of the hub, in particular the part of the hub which forms the outer boundary of the hub, and the body are one-piece. In other words, the hub is also made of the second material. In this way, it is possible to create the hub and the body in one step, which simplifies production. This also increases stability and robustness. Particularly preferably, the second material is a plastic, and the hub and bodies are preferably created by plastic injection molding.

For example, each stabilizing structure protrudes completely through the respective body. For example, the stabilizing structures are attached to the hub, which further increases stability. Alternatively, each stabilizing structure is spaced from the hub and is located only in a radial outer area of the respective fan blade. In this way, the weight of the fan blades is reduced. During operation an increased load occurs in the radial outer area of the fan blades, where, however, deformations are safely avoided by means of the stabilizing structures.

For example, each stabilizing structure is formed by means of an at least partially radially extending strut. Here, the strut conveniently imitates the shape or at least the course of the respective fan blade. Particularly preferably, the stabilizing structure comprises a plurality of at least partially radial struts, wherein in particular by means of each of the struts, the course of the respective fan blade is at least approximately imitated. Thus, for example, struts run at least partially parallel to each other or are slightly inclined to each other. Particularly preferably, the struts are offset to each other, in particular in the tangential direction. Preferably, therefore, all struts of all fan blades are arranged substantially in a common plane, which facilitates production. For example, the struts of each fan blade are attached to each other, in particular by means of cross struts. Particularly preferably, however, these are not attached to each other and are spaced from each other, which facilitates production. It is also possible to manufacture the struts separately in this way. In particular, the struts are designed as an extruded profile, so that bulk stock can be used to provide the stabilizing structure, which further reduces manufacturing costs.

For example, the cross-section of the struts, in particular perpendicular to their respective course, is substantially square or round. Alternatively, the cross-section of the struts is rectangular, wherein the length of one of the sides is increased. Particularly preferred here is the length of the cross-section in the axial direction, i.e., in a direction which is parallel to the axis of rotation, increased as compared to the tangential direction. In other words, the extension of the struts in the axial direction is increased. In this way, a stability of the struts in this direction is increased, so that a bending of the radial outer end fan blades is avoided comparatively safely. Due to the reduced extension in the tangential direction, the weight of the struts is comparatively low. Due to the reduced extension in the tangential direction, stability of the struts in this direction is thus reduced. However, each fan blade, namely the body, has a comparable large extension in this direction, so that a comparatively large stability is still provided. If the cross-section of the struts deviates, or the stabilizing structures have no struts, however, the stability of the stabilizing structures in the axial direction is particularly preferably increased as compared to the tangential direction.

For example, each of the fan blades ends bluntly in the radial direction. Alternatively, the radial outer ends of the fan blades are bent, in particular in the manner of a winglet. Particularly preferably, however, the fan wheel has an outer ring which is arranged concentrically to the hub, and to which the radial outer ends of the fan blades are connected. Thus, the fan blades are additionally stabilized by means of the outer ring. The outer ring, for example, is essentially hollow-cylindrical. For example, the outer ring has in the axial direction, i.e., parallel to the axis of rotation, an extension between 1 cm and 10 cm, for example between 2 cm and 5 cm and suitably equal to 3 cm. By means of the outer ring, in particular, leakage air between the fan wheel and a potential fan frame surrounding the fan wheel circumferentially is limited or prevented. Conveniently, a seal is connected to an outside of the outer ring for this purpose, for example a brush seal. Alternatively, or in combination thereto, the outer ring is manufactured at least in sections in the manner of a labyrinth seal and therefore conveniently has a contour which in the assembly state engages in a corresponding contour, in particular the possible fan frame, but is spaced from this. Thus, on the one hand, friction is not increased, and, on the other hand, air is prevented from passing through between the fan wheel and the frame, in particular against the direction of travel. Thus, efficiency is further increased. Due to the stability increased by means of the stabilizing structures, it is possible to select a comparatively small distance between the interlocking contours, so that a sealing effect of the labyrinth seal is improved.

For example, the outer ring is one-piece and, for example, made of a plastic. Particularly preferably, the outer ring is attached to the bodies of the fan blades and, for example, one-piece with these. In this way, production in a joint work step is possible, which further simplifies production. In a further alternative, the outer ring has a further stabilizing structure of another first material, which is surrounded by means of another body of another second material, for example completely. Thus, the shape of the outer ring is stabilized by means of the further stabilizing structure, wherein the shape of the outer ring is predetermined by means of the further body. Due to the further stabilizing structure, the fan blades are further stabilized, wherein the weight of the fan wheel is not excessively increased. Thus, it is possible to design the potential interlocking contours with the fan frame comparatively filigree, wherein the special material properties of the first material do not have to be taken into account. Due to the further stabilizing structure, it is possible to select the distance between the individual contours comparatively small, so that the sealing effect of the labyrinth seal is further improved.

For example, the first material is equal to the further first material and/or the second material is equal to the further second material, so that the number of different materials is reduced. Thus, contact corrosion is avoided and a wide variety of materials is not necessary. Preferably, the further second material is chosen to be equal to the second material, and in particular, the bodies and the further body are created in one step, preferably by means of plastic injection molding. Particularly preferably, the hub is also made of the second material, so that the number of required work steps for the production of the fan wheel is further reduced.

For example, the stabilizing structures and the further stabilizing structure are spaced from each other. Particularly preferably, however, these are attached directly to each other and preferably one-piece with each other. In this way, the stability of the fan wheel is further increased, and the fan blades are mutually stabilized by means of the further stabilizing structure. Also, in this way, production is simplified, in particular if the further body and the bodies are created together by overmolding the respective stabilizing structures. Consequently, it is only necessary to place the stabilizing structures attached to the further stabilizing structures in a corresponding mold, which is subsequently sprayed out by means of the second material. Here, the positioning of the stabilizing structures by means of the further stabilizing structure is possible, so that scrap is reduced.

For example, the further stabilizing structure has several regions spaced from each other. Alternatively, or in combination thereto, the further stabilizing structure comprises several zigzag-shaped sections. Particularly preferably, however, the further stabilizing structure has a hollow cylinder concentrically arranged to the hub and is preferably formed by means thereof. In this way, the weight of the further stabilizing structure is reduced, wherein robustness in the axial direction is increased. The stability in the radial direction is reduced. In this direction, however, only small forces act on the outer ring during operation, which are also absorbed by means of the fan blades connected to the outer ring.

The radiator fan is a component of a motor vehicle and is conveniently used to cool an internal combustion engine. In other words, the radiator fan is a main fan. Alternatively, the radiator fan is, for example, a component of an air conditioning system or an auxiliary unit of the motor vehicle. The radiator fan conveniently comprises a radiator, having in particular a radiator network through which a number of pipes is preferably passed. For example, the radiator network is thermally contacted with the pipes. Within the pipes, a coolant is preferably conducted during operation. The radiator network, for example, is essentially rectangular. In addition, the radiator fan includes a fan frame, which has a round recess. Within the round recess, advantageously parallel to this and/or the fan frame, a fan wheel with a hub is arranged to which a number of fan blades is connected. The fan blades each have a stabilizing structure made of a first material, which is surrounded by means of a respective body of a second material. Preferably, the fan wheel is arranged concentrically to the recess.

In addition, the radiator fan comprises an electric motor, which is, for example, a brushed commutator motor or preferably a brushless DC motor (BLDC). The electric motor is attached to the fan frame. For example, the fan frame comprises a motor mount which is held above the recess by means of a number of mounting struts. Here, an axis of rotation of the electric motor is arranged perpendicular to the recess and runs in particular on the axis of rotation of the fan wheel, preferably on a straight line that extends through the center of the recess. For example, the electric motor is glued or screwed to the motor mount. Thus, the electric motor is held comparatively securely to the motor mount.

The fan wheel is driven by means of the electric motor and preferably connected to it, for example to a shaft of the electric motor. For example, the hub is mechanically coupled directly to the electric motor. For example, the fan wheel comprises the outer ring to which the fan blades are connected at their radial end. In particular, the outer ring engages in a corresponding receptacle or contour of the fan frame, wherein these are preferably spaced from each other. In particular, a labyrinth seal is formed between them. Thus, a spread of leakage air is prevented. Alternatively, or in combination thereto, a brush seal or the like is arranged between a potential outer ring and the fan frame.

The fan frame is preferably connected to the radiator, expediently attached. For example, the fan frame is screwed to the radiator or glued to it. In particular, the fan frame covers the potential radiator network. In other words, the fan frame is congruent to the radiator network or, for example, the complete radiator. Thus, a passage of air between the radiator and the fan frame is prevented, and by means of the fan frame consequently a comparatively efficient guidance of the air takes place. The fan frame is preferably arranged downstream of the radiator, i.e., conveniently in the direction of travel of the motor vehicle behind the radiator.

The advantages and further developments mentioned in connection with the fan wheel are analogously also to be transferred to the radiator fan and vice versa.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
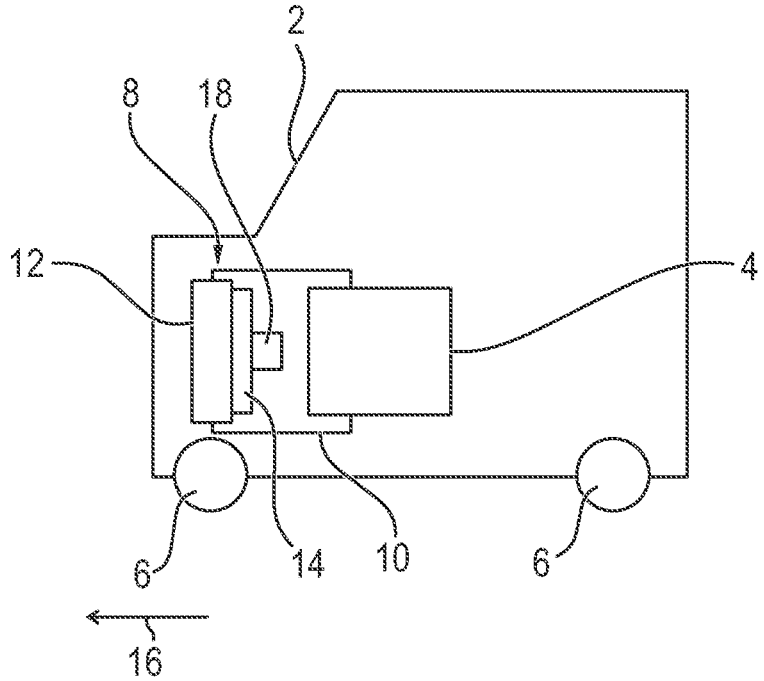
FIG. 1 schematically shows a land-based motor vehicle with a radiator fan.

FIG. 1 shows a schematically simplified motor vehicle 2 in the form of a passenger car, having an internal combustion engine 4. The motor vehicle 2 is driven by means of the combustion engine 4. For this purpose, the combustion engine 4, by means of an unspecified drive train, is in active connection with at least one of the four wheels 6 of the motor vehicle 2. In addition, the motor vehicle 2 comprises a radiator fan 8, which serves to cool the combustion engine 4. Thus, the radiator fan 8 is a main fan of the motor vehicle 2. The radiator fan 8 is fluidically connected to the combustion engine 4 by means of a number of lines 10, through which a coolant is led during operation from the radiator fan 8 to the combustion engine 4 and through cooling channels therein. By means of the coolant, excess heat is absorbed and led back to the radiator fan 8, by means of which a cooling of the coolant takes place.

The radiator fan 8 comprises a radiator 12 with a radiator network, not further shown, through which a number of pipes are passed and are thermally contacted with it. The pipes are fluidically coupled with the lines 10, so that during operation, the coolant is passed through the pipes. The radiator fan 8 further comprises a fan frame 14, which is arranged in a direction of travel 16 of the motor vehicle 2 behind the radiator 12. An electric motor 18 is attached to the fan frame 14. During operation, an air stream passes through the radiator 12 and is suitably shaped by means of the fan frame 14. When the motor vehicle 2 is stopped, air is sucked through the radiator 12 by means of the electric motor 18, so that the radiator 12 is essentially always, or at least depending on existing requirements, interspersed with the air stream during operation. Thus, a cooling of the radiator 12 takes place, which is why even after a comparatively long operation of the combustion engine 4 no overheating of the radiator fan 8 takes place. In addition, by means of the fan frame 14, the air passing through the radiator fan 8 is directed to the combustion engine 4 and the latter is additionally cooled in this way from the outside.

Figure 2:
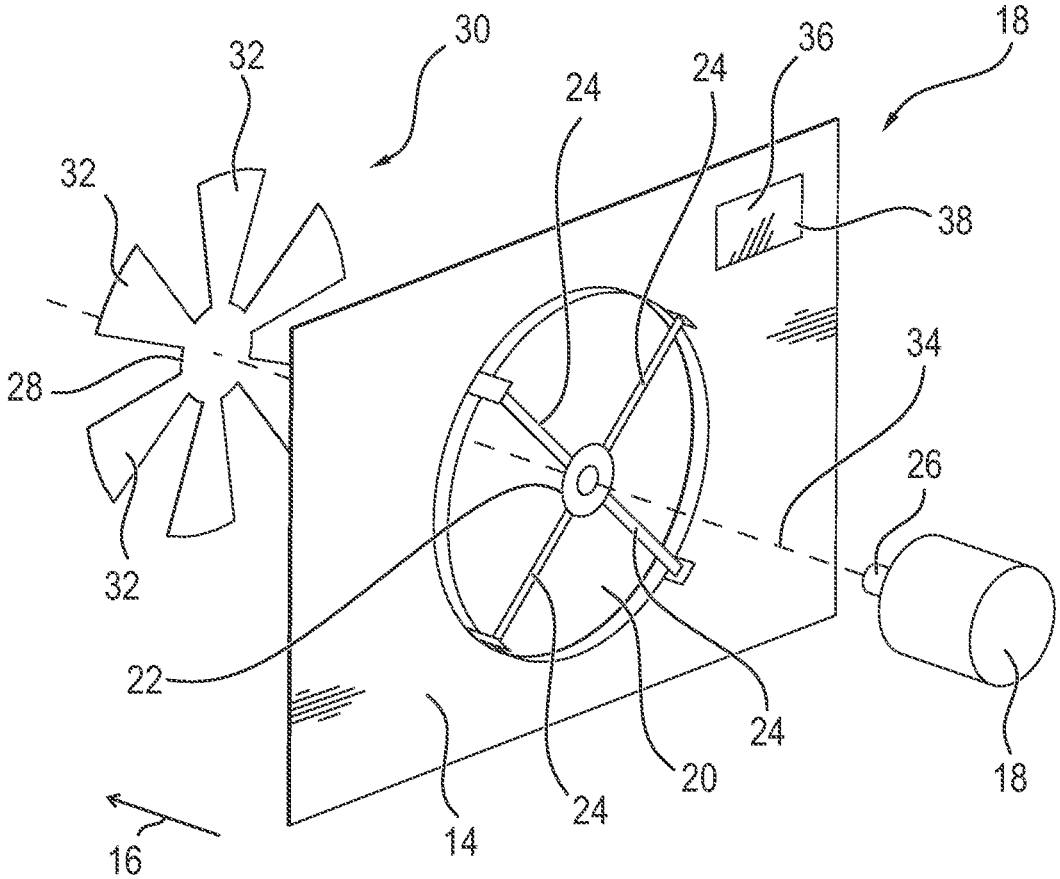
FIG. 2 schematically shows simplified in an exploded view, partially the radiator fan with a fan wheel.

FIG. 2 shows the radiator fan 8 schematically simplified, in perspective in an exploded view, wherein the radiator 12 is omitted. On the radiator 12, the fan frame 14 is attached, which completely covers the radiator network, not shown, and is congruent with this. The fan frame 14 is essentially flat and has a round recess 20, which is oriented perpendicular to the direction of travel 16, and which has a diameter of 30 cm.

The fan frame 14 further comprises a motor mount 22, which is arranged counter the direction of travel 16 above the recess 20 and held there by means of a plurality of mounting struts 24. In the assembly state, the electric motor 18 is held by means of the motor mount 22 and the electric motor 18 thus attached to this. Here, the electric motor 18 is located on the opposite side of the radiator 12 of the fan frame 14. A shaft 26 of the electric motor 18 protrudes in the direction of travel 16 through the motor mount 22 and is attached in a rotationally fixed manner to a hub 28 of a fan wheel 30. Thus, the fan wheel 30 is driven by means of the electric motor 18, which is held by means of the motor mount 22. At the hub 26, a number of fan blades 32 is connected.

In the assembly state, the fan wheel 30 is arranged parallel to the recess 20 within this and is rotated during operation by means of the electric motor 18 about an axis of rotation 34, which is parallel to the direction of travel 16, and which extends through the center of the recess 20. Thus, air is sucked through the recess 20 counter the direction of travel 16 during operation.

In addition, the fan frame 14 comprises a dynamic pressure damper 36, which comprises an opening which is covered by a flap 38. If there is a comparatively high (air) pressure in the direction of travel 16 in front of the fan frame 14, in particular with a comparatively fast movement of the motor vehicle 2, the passage of air through the recess 20 is partially hindered due to the fan wheel 30 or the fan wheel 28 30 can be rotated comparatively quickly. However, this would lead to an increased load on the electric motor 18 and the other component and to increased noise. From a certain pressure, the flap 38 is therefore swiveled and the opening released so that air can flow through it. Thus, an air stream through the radiator 12, which is located in the direction of travel 16 in front of the fan frame 14, is increased. At a comparatively low air pressure in front of the fan frame 14, as is the case with a standstill of the motor vehicle 2, the flap 38 is closed, so that the formation of a circular air stream passing only through the opening of the dynamic pressure damper 36 and the recess 20 is prevented. Thus, the radiator 12 is always interspersed by means of a sufficient air stream.

Figure 3:
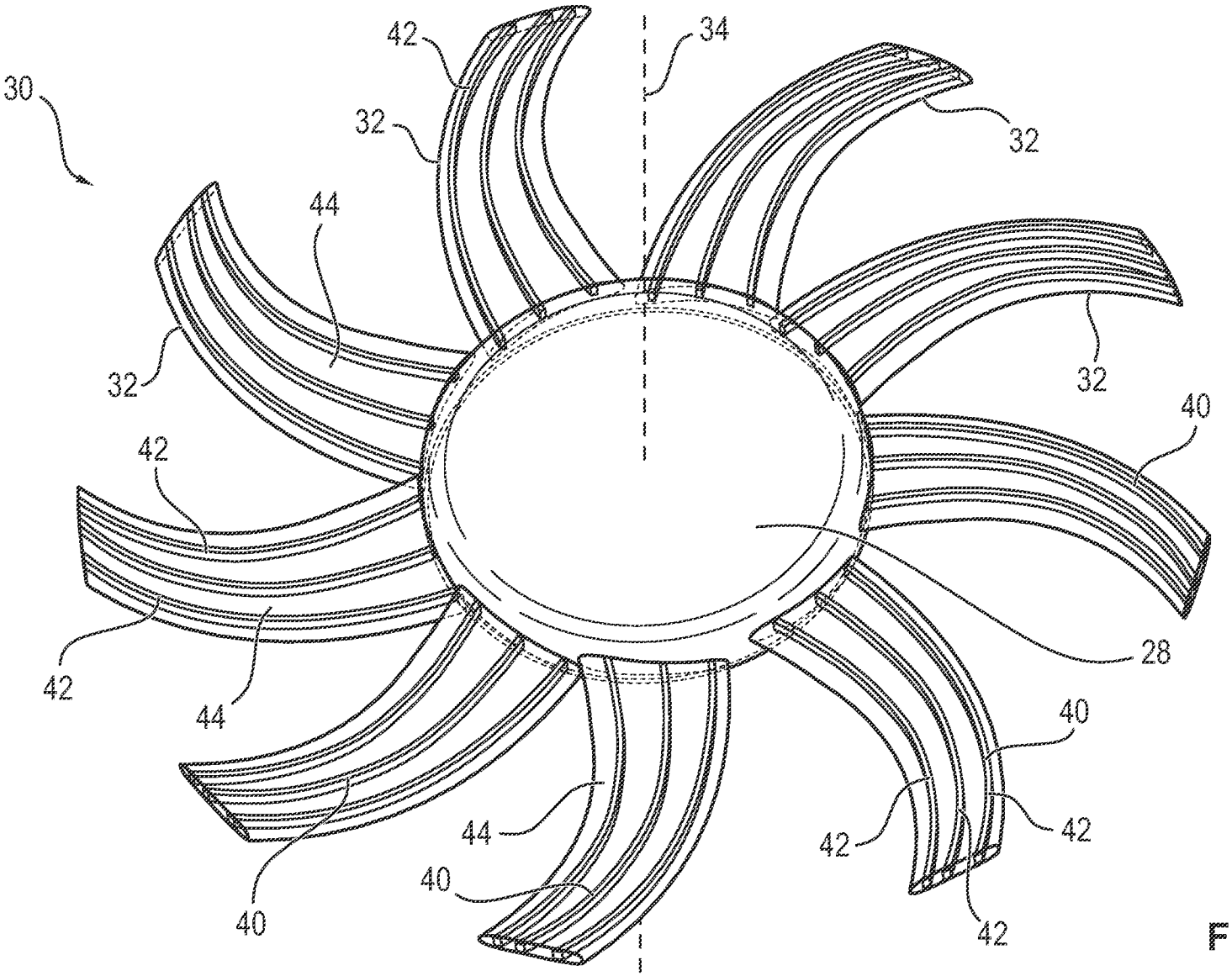
FIG. 3 shows in perspective, the fan wheel having a plurality of fan blades.
Figure 4:
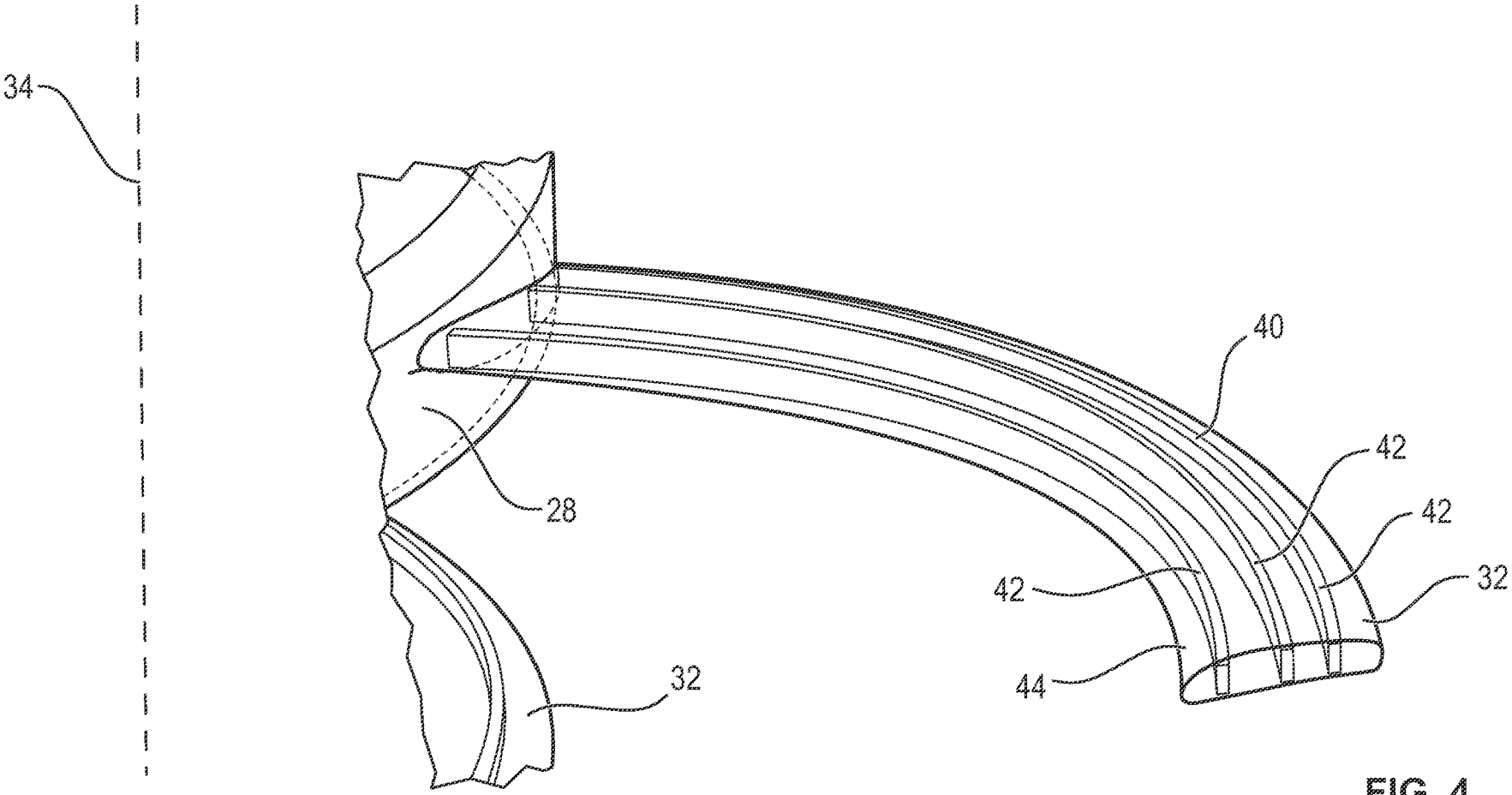
FIG. 4 shows in part an end region of one of the fan blades.

FIG. 3 and FIG. 4 show, enlarged in sections in perspective in a semi-transparent representation, the fan wheel 30 which is rotationally symmetrical with respect to the axis of rotation 34. The fan wheel 34 comprises the pot-shaped hub 28, to which in this example a total of nine fan blades 32 are connected, which run partly radially and partly tangential with respect to the axis of rotation 34. In other words, the fan blades have a crescent shape, wherein these constantly face the same direction in the tangential direction. To create the air stream through the fan frame 14, the fan blades 32 are inclined slightly perpendicular to a plane perpendicular to the axis of rotation 34. The radial ends of the fan blades 32 with respect to the axis of rotation 34 are bluntly designed in this embodiment, and the fan wheel 30 is thus without an outer ring.

Each of the fan blades 32 comprises a stabilizing structure 40, which is formed by means of three spaced struts 42. The struts 42, and thus the respective stabilizing structure 40, is made of a first material, namely a steel. As a result, the struts 42 have a comparatively high stability, but the weight is increased. The struts 42 are identical to each other or at least built from the same by means of cutting to length and suitable bending so that all struts 42 have the same cross-section over their complete course.

Here, the course of the struts 42 is substantially equal to the course of the respective fan blade 32, wherein the radial outer ends of the struts 42 of the respective stabilizing structure 40 are offset to each other, so that do not have a completely parallel course. The struts 42 extend in this embodiment from the radial outer end of the respective fan blade 32 to the hub 28. In a variant, not shown, the struts 42 are shortened so that they are radially offset outwards from the hub 28. The struts 42 have a substantially rectangular cross-section perpendicular to their course. Here, their extension is increased in the axial direction, i.e., parallel to the axis of rotation 34. In this way, the stability of struts 42 in this direction is increased.

Each of the fan blades 32 further comprises a body 44 which is made of a second material, namely a plastic, by overmolding the respective stabilizing structure 40. Thus, the second material differs from the first material. Each body 44 is also arranged between the individual struts 42 of the same fan blade 32, and these are held captively by means of the respective body 44. By means of the respective body 44, the external shape of the respective fan blade 32 is predetermined, and the struts 42, and consequently also each stabilizing structure 40, are completely surrounded by the respective body 44, except for their respective ends.

The bodies 44 are made of the second material, namely a polyamide, wherein the hub is also made of the second material. The hub 28 and the body 44 are one-piece, so that a separate attachment of the fan blades 32 to the hub 28 is not required. Robustness is also increased in this way. For the production of the fan wheel 30, the stabilizing structures 40 are suitably positioned within a mold, which is subsequently filled by means of the second material by injection molding, so that all cavities of the mold are filled. As a result, the bodies 44 and the hub 28 are created, wherein the stabilizing structures 40 are surrounded by the respective bodies 44.

Figure 5:
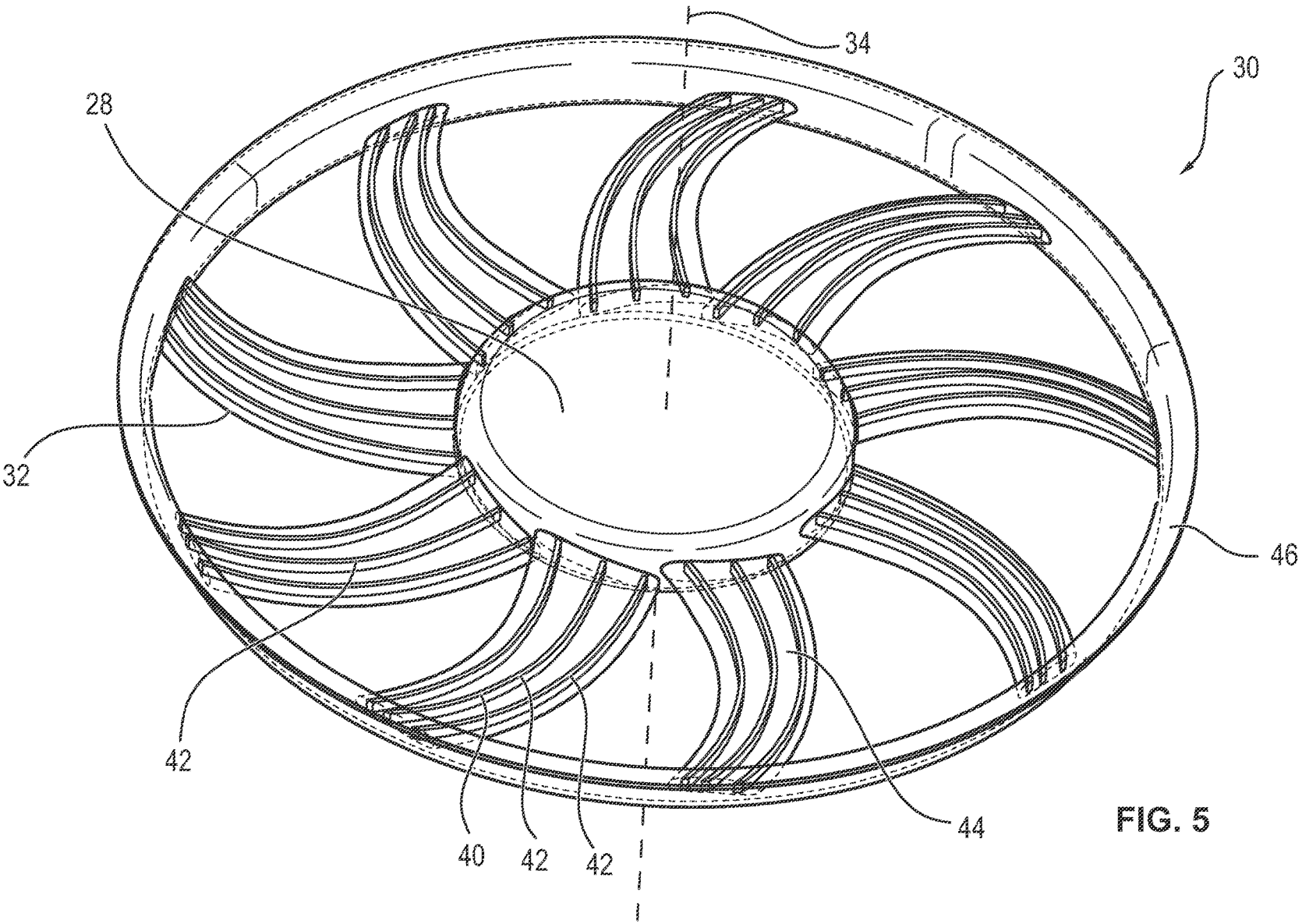
FIGS. 5 and 6 show in each case, in perspective, a variant of the fan wheel.

FIG. 5 shows an alternative embodiment of the fan wheel 30, wherein the hub 28 and the fan blades 32 are not changed. However, the fan blades 32 are surrounded by an outer ring 46 arranged vertically and concentrically to the axis of rotation 34. Thus, the outer ring 46 is also concentric to the hub 28, and these are essentially arranged in a common plane which is perpendicular to the axis of rotation 34. The radial outer ends of the fan blades 32 are attached to the outer ring 46. The outer ring 46 is created one-piece from the second material and formed on the bodies 44. In production, the outer ring 46 is created in one step with the hub 28 and the bodies 44 by injection molding.

The outer ring 46 has an essentially L-shaped cross-section, which thus comprises two legs. In this case, one of the legs is arranged parallel to the axis of rotation 34, and the remaining one points radially outwards from this. In this way, stability is increased, wherein the weight of the fan wheel 30 is not excessively increased. In the assembly state, an unspecified contour arranged on the radially outwardly projecting leg engages in a corresponding contour of the fan frame 14, which surrounds the recess 20, so that a labyrinth seal is created. In this way, leakage air between the fan wheel 30 and the fan frame 14 is minimized.

Figure 6:
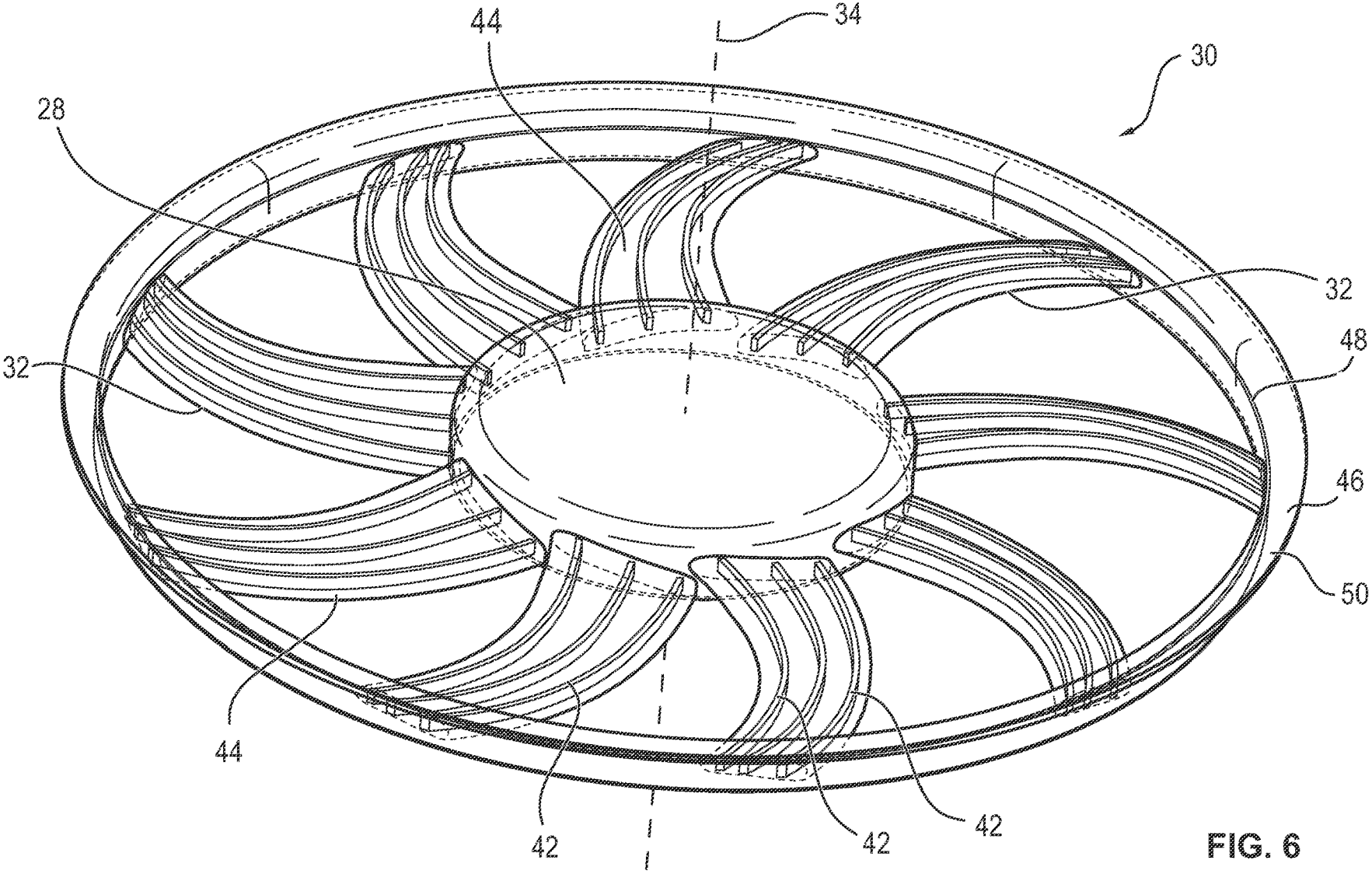

FIG. 6 shows a further modification of the fan wheel 30. The hub 28 is not changed. Also, the outer ring 46 is again present. However, this is no longer merely designed in one piece, but has a further stabilizing structure 48, which is formed by means of a hollow cylinder made of a further first material and arranged concentrically to the hub 28 and thus also to the axis of rotation 34. The other first material is equal to the first material and thus a steel.

Compared to the preceding embodiment, in the fan blades 32, the struts 42 are slightly extended at their radial outer end, and welded to the further stabilizing structure 48, i.e., the hollow cylinder. Thus, the stabilizing structures 40 and the further stabilizing structure 48 are directly attached to each other.

The further stabilizing structure 48 of the outer ring 46 is surrounded by another body 50 from the further second material. By means of the further body 50, the outer shape of the outer ring 46 is specified, which corresponds to the outer shape of the preceding embodiment. The further second material is the same as the second material, and the further body 50 is formed in one piece with the respective bodies 44.

To produce this fan wheel 30, the further stabilizing structure 48, to which the stabilizing structures 40 are already attached, is inserted into a corresponding mold, which is subsequently filled by means of the second material, which also forms the further second material, so that the stabilizing structures 40 and the further stabilizing structure 48 are overmolded by means of the second material and thus surrounded. The hub 28 is also created. Due to the further stabilizing structure 48, the positioning of the stabilizing structures 40 within the mold is facilitated.

The invention is not limited to the embodiments described above. Rather, other variants of the invention can be derived from it by the skilled person without departing from the subject-matter of the invention. In particular, all the individual features described in connection with the individual embodiments can also be combined in other ways without departing from the subject-matter of the invention.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A fan wheel of a motor vehicle, the fan wheel comprising:

a hub to which at least two fan blades is connected; and a stabilizing structure formed on each of the at least two fan blades, the stabilizing structure comprising a first material surrounded by a respective body of a second material, wherein the fan blades are connected at their radial outer end to an outer ring arranged concentrically to the hub, wherein the outer ring has a further stabilizing structure of another first material, which is surrounded by another body of another second material, and wherein the stabilizing structure and the further stabilizing structure are directly attached to each other.

2. The fan wheel according to claim 1, wherein the respective body of the second material and the another body of the second material are formed by overmolding each stabilizing structure.

3. The fan wheel according to claim 1, wherein the hub and the body are one-piece.

4. The fan wheel according to claim 1, wherein each stabilizing structure has at least two at least partially radially extending struts.

5. The fan wheel according to claim 4, wherein an extension of the at least two at least partially radially extending struts increases in an axial direction.

6. A radiator fan of a motor vehicle, the radiator fan comprising:

a fan wheel, the fan wheel comprising:

a hub to which at least two fan blades is connected; and a stabilizing structure formed on each of the at least two fan blades, the stabilizing structure comprising a first material surrounded by a respective body of a second material, wherein the fan blades are connected at their radial outer end to an outer ring arranged concentrically to the hub, wherein the outer ring has a further stabilizing structure of another first material, which is surrounded by another body of another second material, and wherein the stabilizing structure and the further stabilizing structure are directly attached to each other; and a fan frame that has a round recess within which the fan wheel is arranged and which is driven by an electric motor that is connectable to the fan frame.

7. A fan wheel of a motor vehicle, the fan wheel comprising:

a hub to which at least two fan blades is connected; and a stabilizing structure formed on each of the at least two fan blades, the stabilizing structure comprising a first material surrounded by a respective body of a second material, wherein the fan blades are connected at their radial outer end to an outer ring arranged concentrically to the hub, wherein the outer ring has a further stabilizing structure of another first material, which is surrounded by another body of another second material, and wherein the further stabilizing structure is a hollow cylinder arranged concentric to the hub.

* * * * *